United States Patent [19]

Nishimura

[11] Patent Number: 4,530,333

[45] Date of Patent: Jul. 23, 1985

[54] AUTOMOBILE FUEL CONTROL SYSTEM

[75] Inventor: Hirofumi Nishimura, Hiroshima, Japan

[73] Assignees: Mazda Motor Corporation, Hiroshima; Mitsubhish Denki Kabushiki Kaisha, Tokyo, both of Japan

[21] Appl. No.: 531,683

[22] Filed: Sep. 13, 1983

[30] Foreign Application Priority Data

Sep. 20, 1982 [JP] Japan ..... 57-164698

[51] Int. Cl.[3] ..... F02D 5/00

[52] U.S. Cl. ..... 123/489; 123/480; 123/486

[58] Field of Search ..... 123/489, 480, 486, 492, 123/440

[56] References Cited

U.S. PATENT DOCUMENTS

| | | | |
|---|---|---|---|
| 4,200,064 | 4/1980 | Engele | 123/489 |
| 4,201,161 | 5/1980 | Sasayama et al. | 123/489 |
| 4,309,971 | 1/1982 | Chiesa et al. | 123/480 |

*Primary Examiner*—Andrew M. Dolinar

*Attorney, Agent, or Firm*—Burns, Doane, Swecker & Mathis

[57] ABSTRACT

A fuel control system for an automobile engine including a fuel intake passage for the flow of a combustible mixture of air and injected fuel towards the engine, an exhaust passage for the discharge of exhaust gases from the engine, an engine rotational speed detector, an engine load detector and a computer for controlling the supply of fuel to be injected in dependence on the concentration of a component of the exhaust gases representing the air-fuel ratio of the combustible mixture. The computer includes a first storage device storing, at each address location determined by a particular combination of engine rotational speed and engine load, a standard control value for the control of the fuel supply and a second storage device storing, for each zone defined by particular engine rotational speed and a load, a correction control value for the correction of the standard control value.

6 Claims, 7 Drawing Figures

AUTOMOBILE FUEL CONTROL SYSTEM

BACKGROUND OF THE INVENTION

The present invention generally relates to an automobile fuel control system and, more particularly, to an air-fuel control system for an internal combustion engine utilizing a closed-loop control operable during a particular engine operating condition to control the air-fuel ratio in dependence on the composition of exhaust gases.

Hitherto, there has been well known an automobile fuel control system wherein an air flowmeter disposed in an air intake passage is used to detect the flow of air sucked into the engine from time to time so that the amount of fuel to be injected can be controlled in dependence on the flow of the air so detected. The known system has an advantage in that, since the amount of air sucked into the engine can be detected directly, the air-fuel ratio of a combustible mixture can be controlled accurately.

However, the air flowmeter is delicate and expensive as is well known to those skilled in the art. Accordingly, when the air flowmeter is used in an automobile fuel control system in combination with a microcomputer, the result would be the increased price of the control system as a whole, and this goes against the recent demand for the accomplishment of an economy. In addition, if the fuel control system of the above described type is also used in combination with an exhaust gas recirculation (EGR) system for the minimization of the atmospheric pollutants, it is well recognized that the accurate air-fuel ratio control cannot be achieved unless the flow of exhaust gases being recirculated is correctly measured.

In view of the above, there has recently been proposed a so-called map control system wherein no air flowmeter is utilized and wherein various sensors such as, for example, an engine rotational speed sensor for detecting the engine rotational speed and a pressure sensor for detecting the absolute pressure within the fuel intake passage, which are generally used for the respective purposes other than for the fuel control, are concurrently utilized to detect an engine operating condition so that a predetermined amount of fuel pre-calculated in dependence on the engine operating condition so detected can be supplied. This fuel control system, i.e., the map control system, has developed into a so-called learning control system wherein change in operating performance of the engine with time (which change is hereinafter referred to as the "aging" of the engine) is taken into consideration in controlling the amount of fuel to be supplied.

As is well known to those skilled in the art, as the engine is operated for an extended period of time, some component part, for example, a valve seat forming a part of the fuel intake valve assembly is worn down to such an extent as to result in the change in timed relationship between the fuel intake valve and the exhaust valve. The wear of the valve seat described above is an example of the engine aging, and once this happens, for a given engine operating condition, the ratio between the amount of a dilution gas and that of an fresh air is adversely affected.

The Japanese Laid-open Patent Publication No. 55-96339, published July 22, 1980, discloses the use of a learning control technique wherein an oxygen sensor disposed in an engine exhaust system is used to determine whether or not the air-fuel ratio of the combustible mixture being supplied is accurately controlled to a stoichiometric value and wherein an amount of fuel appropriate for an individual engine operating condition which is generally determined by the suction pressure and the engine rotational speed is learned beforehand at an appropriate timing by sampling it so that the amount of fuel can be set to a value by the utilization of the learned value.

However, it has been found that, the prior art learning control system has a problem in that, since the oxygen sensor used to determine correctness or incorrectness of the control merely serves to determine whether the air-fuel ratio is lower than the stoichiometric value or whether it is higher than the stoichiometric value, the oxygen sensor even though it can determine that the air-fuel ratio has been enriched when the engine is operated under a high load condition in which the air-fuel is required to be enriched, fails to determine whether or not the amount of fuel being supplied during the high load engine operating condition has been correctly controlled.

Because of the presence of the above described problem, the prior art learning control system is so designed that, during the high load engine operating condition, an open-loop control is effected so as to enable a fixed map control precomputed on the basis of the suction pressure and the engine rotational speed.

SUMMARY OF THE INVENTION

The present invention has been developed with a view to substantially eliminating the disadvantages and inconveniences inherent in the prior art learning control system and has for its essential object to provide an improved fuel control system for an internal combustion engine wherein the fuel control during the high load engine operating condition can be controlled in dependence on the learned value learned during the closed-loop control.

In other words, the present invention is aimed at the optimum control of fuel (air-fuel ratio) at all engine operating condition with due regards paid to the aging of the engine and fluctuations of the engine, which control is accomplished by learning, on the basis of a value learned during the closed-loop air-fuel ratio control, an optimum fuel control value appropriate to any operating state of the high load engine operating condition, and controlling the fuel in dependence on the fuel control value obtained by the learning when such operating state of the high load engine operating condition has been attained. With the fuel control system according to the present invention, it is possible to render the aging and fluctuations of the engine to be reflected even during the open-loop air-fuel ratio control and, therefore, the optimum control of the fuel can be accomplished at all engine operating condition.

For the above described purpose, the fuel control system according to the present invention comprises an air-fuel ratio detector for detecting the air-fuel ratio of a combustible mixture to be supplied to the engine; an engine rotational speed detector for detecting the engine rotational speed; an engine load detector for detecting the engine load imposed on the engine; a first storage means storing, at each of the address locations determined by respective combinations of engine rotational speed and engine load, a standard control value for the control of the amount of fuel to be supplied during a particular engine operating condition; a second storage means storing, for each of a plurality of zones defined by the engine rotational speed and the engine load, a correction control value for the correction of the standard control value; a control signal output means for, when the engine is operating under a high load condition with the engine load being higher than a predetermined value, outputing, as the control value of a control signal, a control value given by the first and second storage means to an engine operating condition then assumed by the engine and also for when the engine is operating under a condition other than the high load engine operating condition with the engine load being consequently lower than the predetermined value, correcting the control value given by the first and second storage means to the engine operating condition then assumed by the engine, in such a manner that the air-fuel ratio of the combustible mixture is rendered to settle within a predetermined value on the basis of an output from the air-fuel ratio detector, and outputing the finally corrected control value as the control value of the control signal; a correction control value modifying means for, during the engine operating condition other than the high load operating condition, modifying on the basis of the control value of the control signal from the control signal output means the correction control value stored in the second storage means and associated with the zone in which the engine is then operating, so that the air-fuel ratio of the combustible mixture to be controlled by the control value given by the first and second storage means can attain the predetermined value, and also for modifying the correction control value, stored in the second storage means at one of the zone corresponding to the high load engine operating condition, on the basis of the correction control value for the zone other than the high load engine operating condition, but for that in which the engine rotational speed is the same as in such zone; and a fuel supplying means adapted to receive the control signal from the control signal output means for controlling the flow of fuel to be supplied to the engine.

It is to be noted that a fuel control system similar to that of the present invention in that the fuel to be supplied during the high load engine operating condition in which the open-loop air-fuel ratio control takes place is corrected on the basis of a value learned during the closed-loop air-fuel ratio control is disclosed in the Japanese Laid-open Publication No. 57-62946 published Apr. 16, 1982. According to this publication, the learned value learned during the closed-loop air-fuel ratio control is determined irrespective of the engine rotational speed. In other words, the value for correcting the flow of fuel to be supplied during the high load engine operating condition is a fixed value irrespective of the engine rotational speed, that is, irrespective of whether the engine rotational speed is low or high. However, in practice, this correction value is of a nature that the value required thereby varies with the engine rotational speed in view of the fact that the amount of variation resulting from, for example, the aging of the engine as hereinbefore discussed is influenced by the engine rotational speed. In addition, in the system disclosed in this publication, no learning control is performed during the closed-loop air-fuel ratio control. Accordingly, with the system disclosed in this publication, the optimum control of the fuel (the air-fuel ratio) with regards paid to the aging and fluctuations of the engine can not be accomplished at all engine operating conditions.

BRIEF DESCRIPTION OF THE DRAWINGS

These and other objects and features of the present invention will become apparent from the following description taken in conjunction with a preferred embodiment thereof with reference to the accompanying drawings, in which.

DETAILED DESCRIPTION OF THE EMBODIMENT

Figure 1:
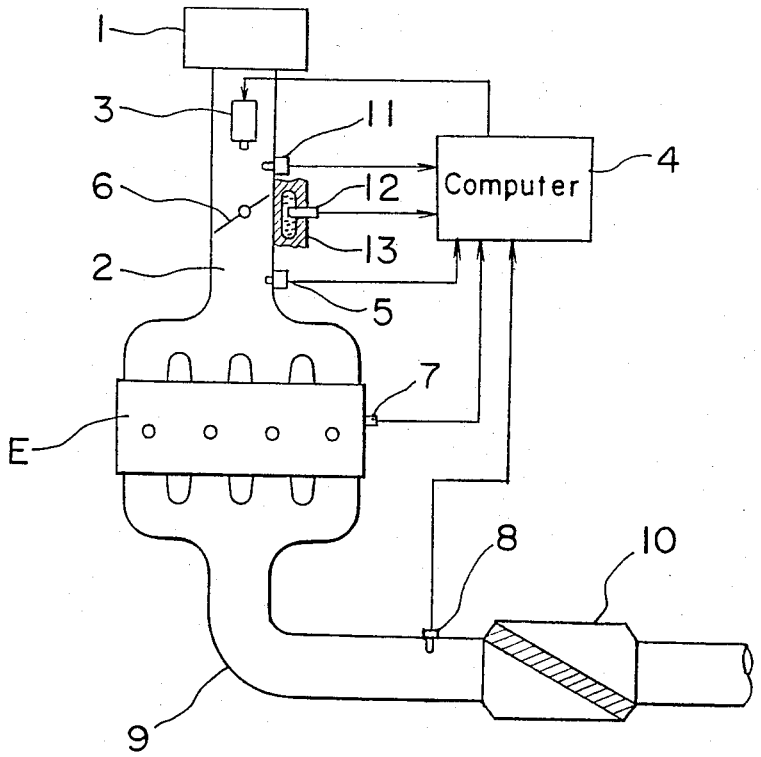
FIG. 1 is a schematic diagram showing an automobile power plant incorporating a fuel control system of the present invention.

Before the description of the present invention proceeds, it is to be noted that like parts are designated by like reference numerals throughout the accompanying drawings.

Referring first to FIG. 1, there is schematically shown an automobile power plant comprising an internal combustion engine E, an air cleaner 1 for the supply of a filtered air from the atmosphere to the engine E through a fuel intake passage 2, a fuel injector 3 disposed in the fuel intake passage 2 for injecting fuel thereinto under the control of a computer 4, a throttle valve 6 disposed in the fuel intake passage 2 for regulating the flow of a combustible mixture to be supplied to the engine E, and an exhaust passage 9 for the discharge of exhaust gases from the engine E to the atmosphere through an exhaust gas purifying unit 10. The power plant and its operation are well known to those skilled in the art.

For the purpose of the present invention, the following sensors are employed for providing the computer 4 with various data required for it to generate to the fuel injector 3 a command indicative of the amount of fuel to be injected.

Pressure Sensor 5 . . . Disposed in the fuel intake passage 2 for detecting the pressure downstream of the throttle valve 6 with respect to the direction of flow of the combustible mixture towards the engine E.

Engine Speed Sensor 7 . . . For detecting the engine rotational speed.

Oxygen Sensor 8 . . . Disposed in the exhaust passage 9 between the engine E and the exhaust gas purifying unit 10 for detecting the concentration of oxygen contained in the exhaust gases which is a parameter indicative of the air-fuel ratio of the combustible mixture supplied to the engine E.

Air Temperature Sensor 11 . . . For detecting the temperature of the air being sucked through the passage 2.

Coolant Temperature Sensor 12 . . . For detecting the temperature of a coolant water flowing in a water jacket 13 for cooling the engine E.

Figure 2:
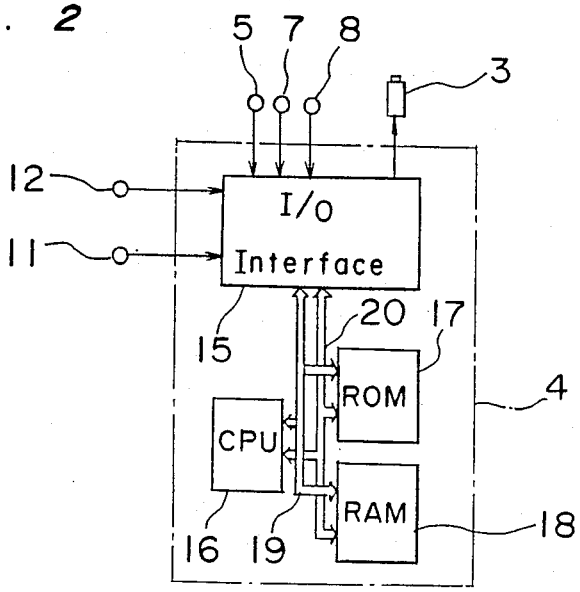
FIG. 2 is a circuit block diagram showing a microcomputer used in the system shown in FIG. 1.

As shown in FIG. 2, the computer 4 is comprised of an input/output interface 15 for the control of input of respective output signals from the sensors 5, 7, 8 11 and 12 and the control of output of the command to the fuel injector 3, a central processing unit (CPU) 16, a read-only memory (ROM) 17, and a random access memory (RAM) 18, all being interconnected by data buses 19 and address buses 20.

A portion of ROM 18 is constituted by a standard control value map in which a standard amount Q'(r, v) of fuel to be injected (which amount of fuel to be injected is hereinafter referred to as the "injection amount") is stored at each address location specified by a particular engine rotational speed and a particular absolute pressure inside the fuel intake passage. This portion of ROM 18 is used as a first storage device in the practice of the present invention.

Figure 5:
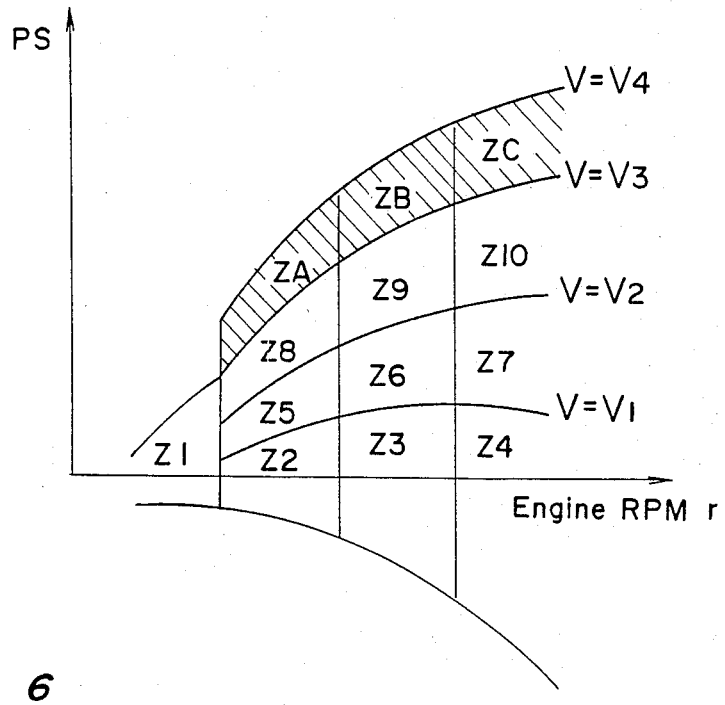
FIG. 5 is a graph showing a plurality of zones of engine operating conditions defined by a particular engine rotational speed and a particular engine output.

Similarly, a correction control value K3 as will be described later is updatably stored, as a leaned value, in RAM 18 for each of a plurality of zones Z1 to Z10 and ZA tc ZC defined by respective combinations of engine rotational speed r and suction pressure V as shown in FIG. 5. A portion of this RAM 18 is used as a second storage device in the practice of the present invention.

Figure 3:
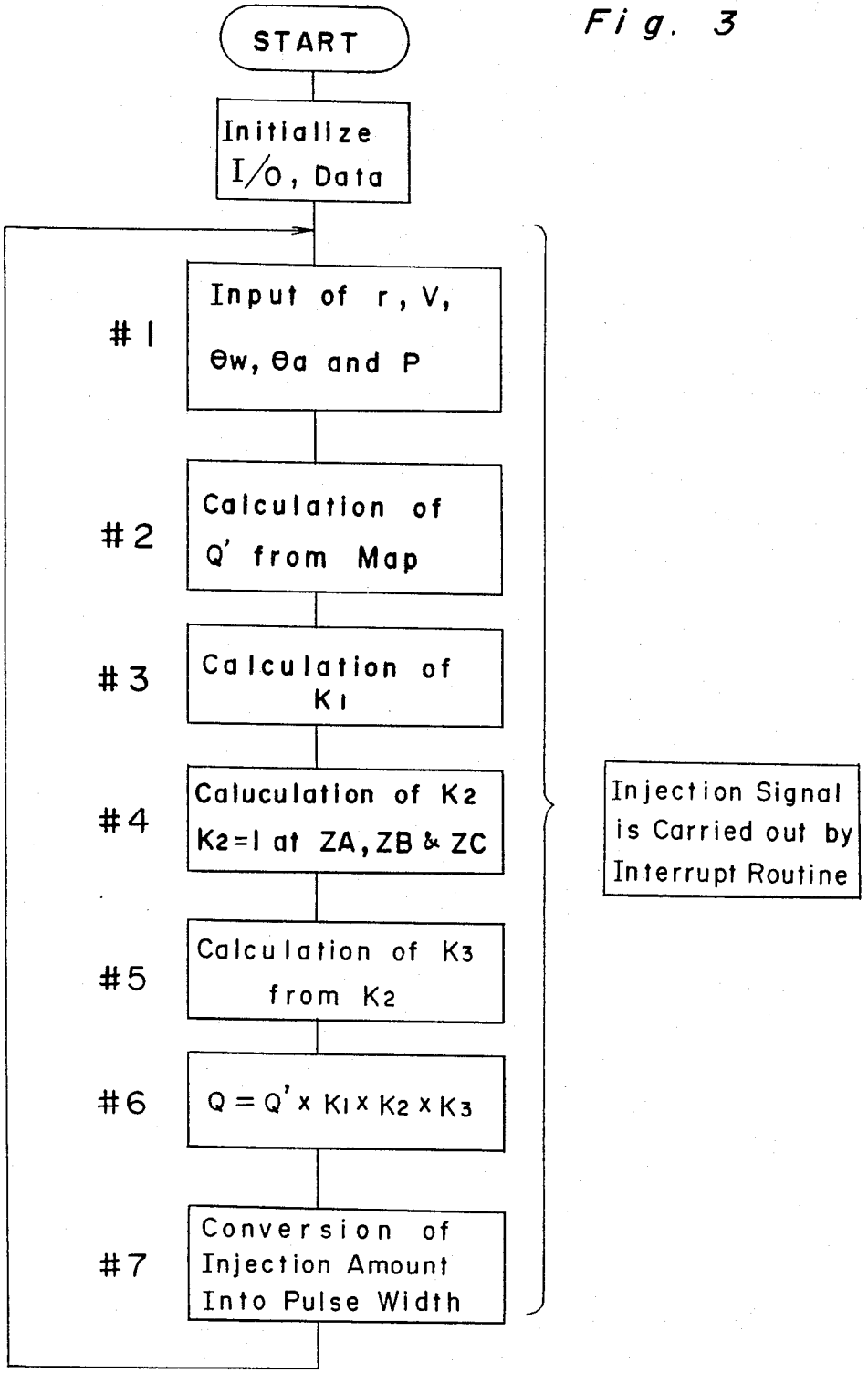
FIG. 3 is a flow chart showing a main routine of the program for the control of fuel.

CPU 16 of the computer 4 is operable to determine a pulse width during the execution of such a main routine as shown in FIG. 3 and to generate the pulse during the execution of the main routine and in response to an interrupt signal.

This fuel control routine is repeatedly executed after the interface 15 and necessary data have been initialized in response to a start signal and is generally programmed as will now be described with reference to FIG. 3.

Referring to FIG. 3, after the initialization, the program flow proceeds to a step #1 wherein the respective signals indicative of the engine rotational speed r, the suction pressure V, the coolant temperature $\theta$w, the air temperature $\theta$a and the oxygen concentration P fed from the associated sensors 7, 5, 12, 11 and 8 are read in through the interface 15. At the subsequent step #2, the engine operating condition is detected from the engine rotational speed and the suction pressure V and the standard injection amount Q'(r, V) appropriate to the detected engine operating condition is read out from a standard control value map in the first storage device. Thereafter, the program flow proceeds to a step #3 wherein a temperature correction coefficient K1(Qw, Qa) appropriate for the standard injection amount Q' is calculated from the coolant and air temperatures Qw and Qa which have been read in. The calculation of this temperature correction coefficient K1 may be carried out by the use of either the above described map or equations. In either case, the temperature correction coefficient K1 has to be set a greater value during the cold start of the engine at which time the coolant temperature $\theta$w is low and/or during the cold weather in which the air temperature $\theta$a is low, than during the normal drive of the engine.

At a step #4 following the step #3, an air-fuel correction value K2 is calculated from the oxygen concentration P. By way of example, where the oxygen concentration P detected by the oxygen sensor 8 during the previous cycle indicated that the air-fuel ratio had been high, but that during the current cycle has indicated that the air-fuel ratio has been high, this air-fuel ratio correction value K2 is of such a value that the previous air-fuel ratio correction value K2 is increased by an increment $\Delta$K2, that is K2←K2+$\Delta$K2, so that the injection amount may correspond to the previous injection amount increased by a suitable increment. On the other hand, if the air-fuel ratio detected by the sensor 8 to be high is subsequently rendered to be low, this accounts that the previous injection amount has been excessive and, therefore, the current air-fuel ratio correction value is set to be of such a value that it is decreased by a decrement $\Delta'$K2, that is, K2←K2−$\Delta'$K2, which decrement is calculated with reference to the previous air-fuel ratio correction value K2.

In the event that the oxygen concentration P detected by the sensor 8 during the previous cycle indicated that the air-fuel ratio had been low and that during the current cycle has indicated that the air-fuel ratio has been high, a decrement $\Delta''$K2 is calculated rendering the current air-fuel ratio correction value K2 to be K2←K2−$\Delta''$K2. However, where the low air-fuel ratio is reversed to be a high air-fuel ratio, an increment $\Delta'''$K3 is calculated rendering the current air-fuel ratio correction value K2 to be K2←K2+$\Delta'''$K2.

It is, however, to be noted that the air-fuel ratio correction value K2 is of a fixed value, i.e., K2=1, during the open-loop control, that is, during the high load engine operating condition (shown by the shaded area in FIG. 6, which condition is hereinafter referred to as an "enrich zone"). Using the air-fuel correction value K2 obtained at the step #4, a correction control value K3 is calculated at the subsequent step #5. The calculation of the correction control value K3 is carried out according to the flow chart of FIG. 4 and, for this purpose, a zone discrimination is carried out in the first place as described with reference to FIG. 5.

Referring now to FIG. 5, a normal operating condition of the engine excluding both the acceleration and the deceleration is divided into a plurality of feedback zones Z1 to Z10 and enrich zones ZA, ZB and ZC according to different states of engine operating condition which are specified by the engine rotational speed 4 and the suction pressure V, and discrimination is made to determine which one of these zones Z1 to Z10 and ZA to ZC a particular state of engine operating condition determined by a particular engine rotational speed r and a particular suction pressure V falls in.

The feedback zones Z1 to Z10 are the zones in which the learning control, that is, the closed-loop control, has to be performed in dependence on the output signal from the oxygen sensor 8, and in these zones, EGR is effected to suppress the emission of NOx. On the other hand, the enrich zones ZA to ZC are the open-loop control zones corresponding to the high load engine operating condition, that is, the zones in which no control can be performed in dependence on the the output signal from the oxygen sensor 8 and the air-fuel ratio is controlled to a lower value than the stoichiometric value. In these enrich zones, EGR is interrupted to ensure a high power output of the engine.

Figure 4:
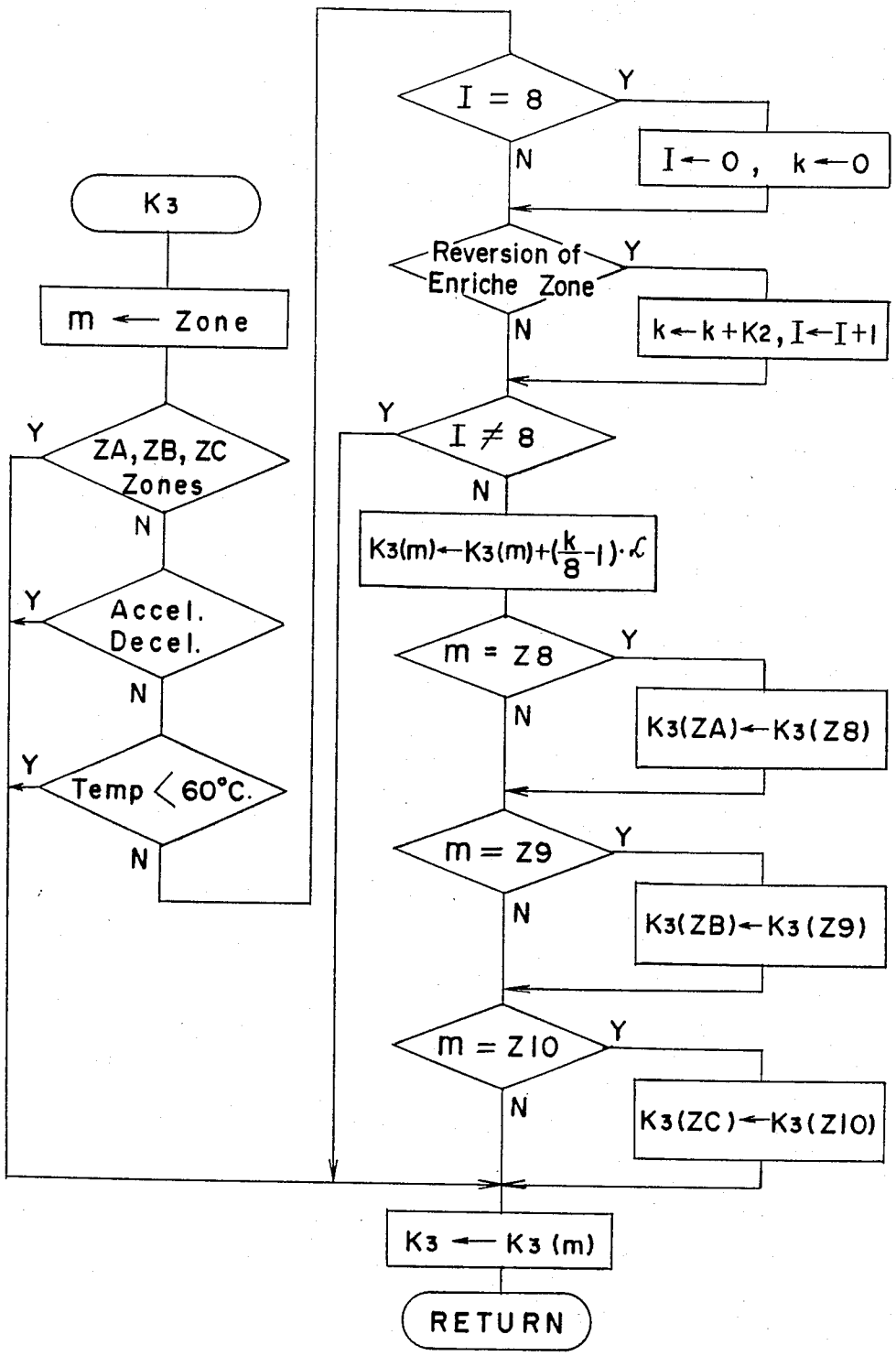
FIG. 4 is a flow chart showing a routine of the program for the computation of a correction value of an engine operating condition.
Figure 6:
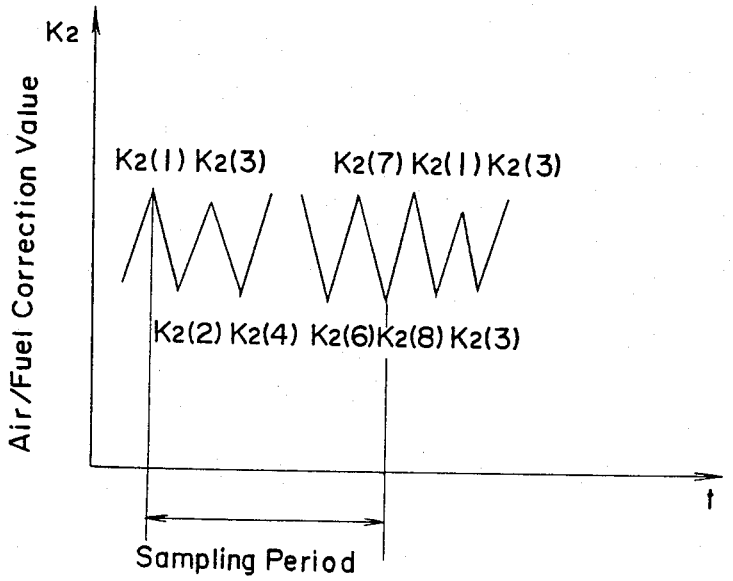
FIG. 6 is a graph used to explain the sampling of the air-fuel ratio correction value.

Referring to FIG. 4, assuming that the engine E is operating under a normal condition, that is, in any one of the feedback zones Z1 to Z10, neither in any one of the enrich zones ZA to ZC nor under any one of the acceleration and deceleration, and the coolant temperature during such engine operating condition is higher than 60° C., sampling such as shown in FIG. 6 is carried out to calculate the correction control value K3.

When the number of the samplings, expressed by I, is eight, that is, I=8, the values I and k (k being a value to be added to the air-fuel correction value K2) are set to be zero. Each time the air-fuel ratio represented by the output signal from the oxygen sensor 8 reverses from a low value to a high value or from a high value to a low value, the sampling is carried out with the air-fuel ratio correction value K2 at such time being taken as the limit value, thereby adding the current sampling value K2 to the previous value k, that is k←k+K2. This sampling is repeated until I=8, and when I=8, the previous correction control value k3(m) (m being a symbol specifying a particular zone) is added with the current amount of correction, i.e., $\Delta K3=((k/8)-1)x\alpha$ to determine the current correction control value K3(m). In this way, in the feedback zones, the correction control value is determined by the learning control for each of the zones m=Z1 to Z10. It is to be noted that $\alpha$ represents a small constant used to avoid any abrupt change of the correction value.

In this learning control process, when m=Z8, the correction control K3(ZA) for the enrich zone ZA adjacent the zone Z8 is updated by the correction control value K3(Z8). Similarly, when m=Z9 or m=Z10, the correction control value K3(Z13) or k3(ZC) is updated by K3(Z9) or K3(Z10), respectively.

The correction control value K3(m) so determined by the foregoing process is read in at a corresponding address location in RAM 18 which constitutes the second storage device, with the previously stored correction control value at such address location being consequently written.

Referring back to FIG. 3, the step #5 is followed by the step #6 wherein the standard injection amount Q', the temperature correction coefficient K1 and the current air-fuel ratio correction value K2, all determined during the previous respective steps, are utilized together with the latest correction control value K3(m) read out from the zone in the second storage device which corresponds to the particular engine operating condition, for the purpose of calculating the standard in1ection amount according to the following equation:

$$Q=Q'\times K1\times K2\times K3$$

The injection amount Q so calculated is converted into a pulse to be applied to the fuel injector 3 at the subsequent step #7 and is converted into a pulse corresponding to the injection amount Q. Then, the injector 3 injects fuel into the fuel passage 2 in a quantity determined by the pulse width corresponding to the injection amount according to the interrupt processing routine.

In the foregoing embodiment, the correction control values K3(ZA), K3(ZB) and K3(ZC) for the respective enrich zones ZA, ZB and ZC have been substituted by the correction control values K3(Z8), K3(Z9) and K3(Z10) for the zones neighboring to these zones ZA to ZC, respectively. However, as shown in FIG. 7, it is possible to employ adequately manipulated values of the learned values learned in the feedback zones in such a way that, for example, the value K3(ZA) is substituted by a mean value of the correction control values K3(Z8), K3(Z5) and K3(Z2) for the closed-loop control wherein the engine rotational speed ranges remain the same.

Figure 7:
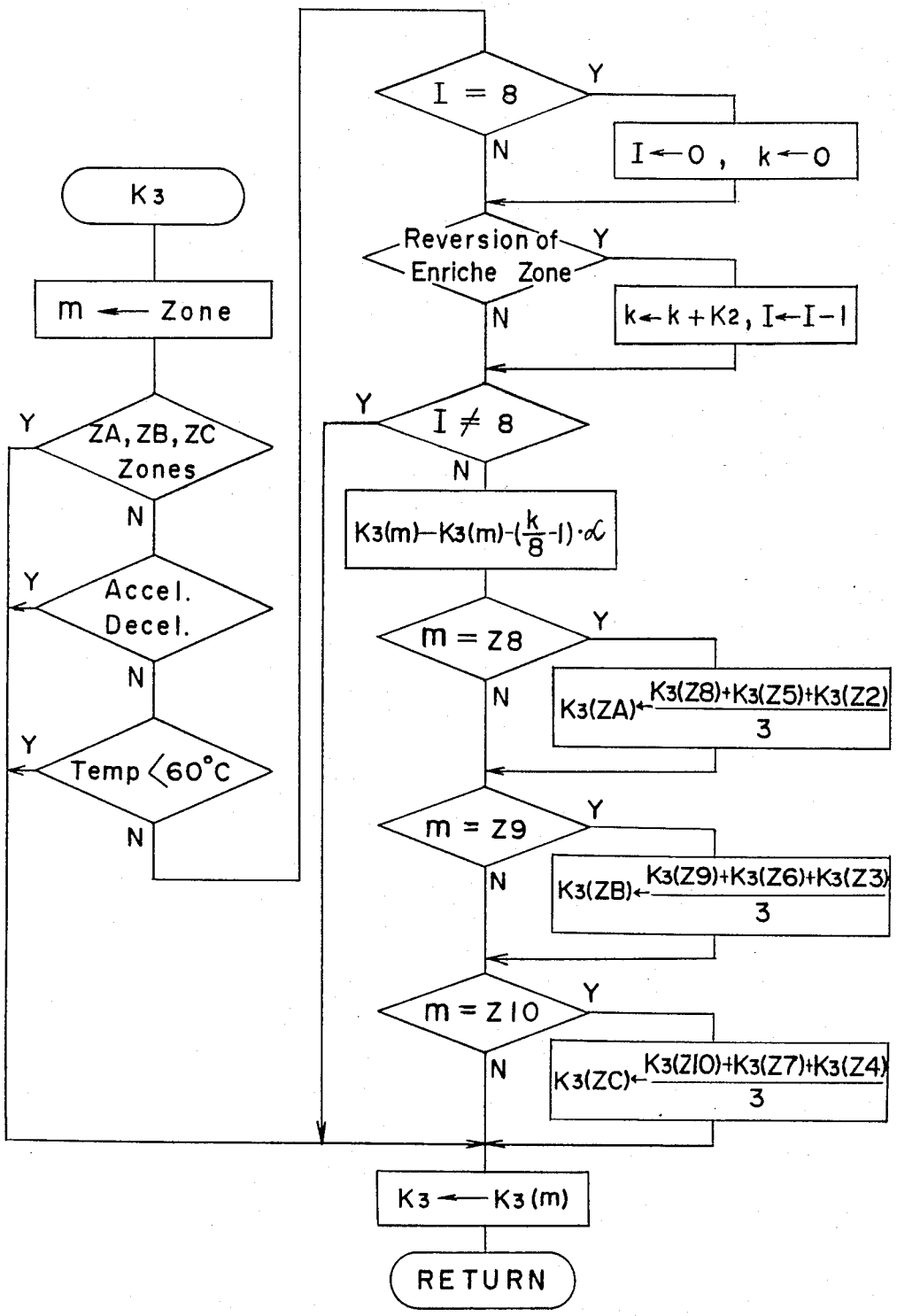
FIG. 7 is a flow chart similar to that of FIG. 4 showing a modified routine.

Specifically, as can readily be understood from the comparison between the flow charts of FIGS. 4 and 7, in the flow chart of FIG. 7, when m=Z8, the correction control value K3(Z8) for the zone Z8 and the respective correction control values K3(Z5) and K3(Z2) for the zones Z5 and Z2 wherein the engine rotational speed range is the same as that in the zone Z8 are added together and then averaged, that is, [K3(Z8)+K3(Z5)+K3(Z2)]. This mean value so calculated is then rendered to be the correction control value K3(ZA) for the enrich zone ZA wherein the engine rotational speed range is the same as that in any one of the zones Z8, Z5 and Z2. A similar description equally applies even when m=Z9 or m=Z10.

From the foregoing description, it has now become clear that, since according to the present invention the control data to be used during the openloop control are updated by the use of the learned values learned during the closed-loop control, an accurate control can advantageously be performed substantially free from any possible adverse influence that the aging of the engine may bring about.

Although the present invention has fully been described in connection with the preferred embodiment thereof with reference to the accompanying drawings, it is to be noted that various changes and modifications are apparent to those skilled in the art. Such changes and modifications are to be understood as included within the scope of the present invention as defined by the appended claims, unless they depart therefrom.

What is claimed is:

1. A fuel control system for an automobile engine which comprises an air-fuel ratio detector for detecting the air-fuel ratio of a combustible mixture to be supplied to the engine; an engine rotational speed detector for detecting the engine rotational speed; an engine load detector for detecting the engine load imposed on the engine; a first storage means storing, at address locations determined by respective combinations of engine rotational speed and engine load, a standard control value for the control of the amount of fuel to be supplied during a particular engine operating condition; a second storage means storing, for each of a plurality of zones defined by the engine rotational speed and the engine load, a correction control value for the correction of the standard control value; a control signal output means for, when the engine is operating under a high load condition with the engine load being higher than a predetermined value, outputting, as the control value of a control signal, a control value given by the first and second storage means to an engine operating condition then assumed by the engine and, when the engine is operating under a condition with the engine load being consequently lower than the predetermined value, for correcting the control value given by the first and second storage means to the engine operating condition then assumed by the engine, in such a manner, that the air-fuel ratio of the combustible mixture is rendered to settle within a predetermined value on the basis of an output from the air-fuel ratio detector, and outputting the finally corrected control value as the control value of the control signal; a correction control value modifying means for, during the engine operating condition other than the high load operation condition, modifying on the basis of the control value of the control signal from the control signal output means the correction control value stored in the second storage means and aasociated with a first zone in which the engine is then operating, so that the air-fuel ratio of the combustible mixture to be controlled by the control value given by the first and second storage means can attain the predetermined value, and for modifying, on the basis of the correction control value for said first zone, the correction control value that is stored in the second storage means at a second zone corresponding to the high load engine operating condition at the same engine rotational speed as in said first zone; and a fuel supplying means adapted to receive the control signal from the control signal output means for controlling the flow of fuel to be supplied to the engine.

2. A system as claimed in claim 1, wherein said correction control value stored in the second storage means at said one of the zones corresponding to the high load engine operating condition is modified on the basis of a correction control value for one of the zones adjacent thereto and other than the zones corresponding to the high load engine operating condition.

3. A system as claimed in claim 1, wherein said correction control value stored in the second storage means at said one of the zones corresponding to the high load engine operating condition is modified to a value equal to a correction control value for one of the zones adjacent thereto and other than the zones corresponding to the high load engine operating condition.

4. A system as claimed in claim 1, wherein said engine load detector comprises a pressure sensor for detecting the absolute pressure inside a suction manifold of the engine.

5. A system as claimed in claim 1, wherein said correction control value stored in the second storage means at said one of the zones corresponding to the high load engine operating condition is modified on the basis of the mean value of correction control values for some of the zones other than the high load engine operating condition, but wherein engine rotational speed ranges remain the same.

6. A system as claimed in claim 1, wherein said correction control value stored in the second storage means at said one of the zones corresponding to the high load engine operating condition is modified to a value equal to the mean value of correction control values for some of the zones other than the high load engine operating condition, but wherein engine rotational speed ranges remain the same.

* * * * *